United States Patent [19]

Dautel et al.

[11] Patent Number: 4,802,628

[45] Date of Patent: Feb. 7, 1989

[54] ROTOR NOZZLE FOR A HIGH-PRESSURE CLEANING DEVICE

[75] Inventors: Heinz Dautel, Backnang; Johann G. Wesch, Berglen, both of Fed. Rep. of Germany

[73] Assignee: Alfred Karcher GmbH & Co., Winnenden, Fed. Rep. of Germany

[21] Appl. No.: 71,193

[22] Filed: Jul. 9, 1987

[30] Foreign Application Priority Data

Jul. 11, 1986 [DE] Fed. Rep. of Germany ..... 3623368

[51] Int. Cl.[4] ..... B05B 3/04

[52] U.S. Cl. ..... 239/227; 239/240; 239/380

[58] Field of Search ..... 239/229, 237, 240, 252, 239/251, DIG. 1, 227, 204, 206, 380

[56] References Cited

U.S. PATENT DOCUMENTS

| | | | |
|---|---|---|---|
| 996,480 | 6/1911 | Glaser . | |
| 1,097,410 | 5/1914 | Flack et al. . | |
| 1,862,381 | 6/1932 | Le Moon . | |
| 1,919,244 | 7/1933 | Munz | 239/240 X |
| 1,970,126 | 8/1934 | Buckner | 239/240 X |
| 2,974,877 | 3/1961 | Hruby et al. | 239/237 |
| 3,107,056 | 10/1963 | Hunter | 239/206 |
| 3,326,468 | 6/1967 | Bristow et al. . | |
| 4,073,438 | 2/1978 | Meyer | 239/237 X |
| 4,320,929 | 3/1982 | Clark et al. . | |
| 4,407,678 | 10/1983 | Furness et al. | 239/240 X |
| 4,708,290 | 11/1987 | Osmond | 239/240 X |

FOREIGN PATENT DOCUMENTS

| | | | |
|---|---|---|---|
| 1139947 | 11/1962 | Fed. Rep. of Germany | 239/251 |
| 7813438 | 9/1978 | Fed. Rep. of Germany . | |
| 7827011 | 1/1979 | Fed. Rep. of Germany . | |
| 2753444 | 6/1979 | Fed. Rep. of Germany . | |
| 7929277 | 2/1980 | Fed. Rep. of Germany . | |
| 3419964 | 12/1985 | Fed. Rep. of Germany . | |
| 3532045 | 3/1987 | Fed. Rep. of Germany | 239/251 |
| 928333 | 6/1963 | United Kingdom | 239/380 |

*Primary Examiner*—Andres Kashnikow
*Assistant Examiner*—Mary Beth O. Jones
*Attorney, Agent, or Firm*—Wolf, Greenfield & Sacks

[57] ABSTRACT

A rotor nozzle for a high pressure cleaning apparatus has a rotor mounted to rotate within a housing driven by the flow of cleaning fluid with a fixed axis of rotation along the longitudinal axis of the housing. A nozzle mounted in an elongated member is captured between a driven portion of the rotor and a cup-like member open at its center and defining an exit orifice of the housing. The end of the nozzle assembly captured in the cup-like member preferably has a ball-shaped end to maintain a good seal. The point of connection of the driver to elongate member is radially offset with respect to the rotor axis of rotation to angle the exit axis of the nozzle at an acute angle with respect to the axis of rotation of the rotor. In an alternative form, the rotor includes counterweights that move radially outward against a spring force to provide an automatic adjustability of the exit angle as a function of the supply of the cleaning liquid.

11 Claims, 3 Drawing Sheets

ROTOR NOZZLE FOR A HIGH-PRESSURE CLEANING DEVICE

The invention relates to a rotor nozzle for a high-pressure cleaning device comprising a housing, a turbine rotor mounted for rotation in the housing and made to rotate by an inflow of cleaning liquid, and a nozzle arranged downstream from the rotor, the exit axis of the nozzle forming an acute angle with the axis of rotation of the rotor and the nozzle being rotated by the rotor about its axis of rotation such that the exiting jet of cleaning liquid moves around the lateral area of a cone.

Such a rotor nozzle is known from German Pat. No. 3,419,964. In this known rotor nozzle, the nozzle which is part of the rotor is supported on the housing by a ball bearing. In high-pressure cleaning devices where very high liquid pressures are used and the cleaning liquid may contain chemicals, sealing problems can occur in the vicinity of this ball bearing if the device is operated for long periods of time.

The object underlying the invention is to so develop a generic rotor nozzle that sealing difficulties are eliminated therein even if in operation for long periods of time.

This object is attained in accordance with the invention in a rotor nozzle of the kind described at the outset by the nozzle being arranged in an elongate member supported at one ball-shaped end in a cup-like member open at the center and held on the housing, while a driver connected to the rotor and spaced radially from the axis of rotation of the rotor to enable free rotation of the elongate member about the longitudinal axis of the elongate member relative to the rotor engages the other end.

With such a design, the longitudinal axis of the elongate member and hence the direction of the exiting jet are altered by the rotational speed of the rotor, i.e., the jet moves at the rotational speed of the rotor along a conical surface, but, on the other hand, the supporting surface of the elongate member at the cup-like member does not rotate at the same—possibly very high-speed since the elongate member can rotate freely about its longitudinal axis relative to the rotor. In practice, the rotational speed of the elongate member about its own longitudinal axis is substantially lower than the rotational speed of the rotor, which substantially reduces wear in the vicinity of the cup-like member. This also results in very advantageous sealing in the region of the cup-like member as the elongate member is pressed firmly at its ball-shaped end against the cup-like member by the pressure of the cleaning liquid passing through the nozzle. This results in perfect sealing in this region.

A driver enabling free rotation of the elongate member about the longitudinal axis may be designed in different ways. For example, the driver may be in the form of a pointed pin which dips into a central recess at the other end of the elongate member.

An embodiment wherein the driver is in the form of a cup-shaped recess into which the other end of the elongate member dips has proven particularly advantageous. This other end is then preferably of spherical configuration. The cup-like recess may likewise have a spherical bottom with adjoining conical walls.

In a preferred embodiment, the elongate member comprises a substantially cylindrical plastic section into which a metal nozzle assembly is inserted. Conventional nozzle assemblies such as employed in high-pressure cleaning devices may be used. These consist of particularly abrasion-resistant hard metal or steel. They may include an integrated diode.

It is advantageous for the nozzle assembly to form the ball-shaped end resting against the cup-like member and for the cup-like member to be made of plastic as the metal/plastic pairing provides particularly favorable bearing conditions.

The elongate member may comprise lateral inlet openings for the cleaning liquid.

In a preferred embodiment, the radial spacing of the driver from the axis of rotation of the rotor is adjustable. The angle of inclination of the longitudinal axis of the elongate member is thereby also adjustable in relation to the axis of rotation and hence also the angle of the exiting jet in relation to the axis of rotation.

It is particularly advantageous for the driver to be pretensioned by spring means in the direction of the axis of rotation of the rotor and to be movable further away from the axis of rotation of the rotor by the action of the centrifugal force when the rotor rotates, against the action of the spring means. In this way, the angle of the elongate member and hence the angle of the exiting jet in relation to the axis of rotation change in dependence upon the speed. At low speeds, this angle is small and as speeds increase, this angle increases, i.e., the apex angle of the cone-shaped jet increases with increasing rotor speed. With such a design, the operator can influence the apex angle of the jet merely by the liquid inflow rate and the rotor speed determined by it.

Centrifugal weights may be movably arranged on the rotor. These may be urged into a position near the axis of rotation by spring means and one of the centrifugal weights may carry the driver.

It is particularly advantageous for two centrifugal weights to be movably arranged on the rotor so as to oppose each other symmetrically with the axis of rotation. This eliminates imbalances during rotation of the rotor.

Provision may also be made for the centrifugal weights to abut the inside wall of the housing at maximum rotor speed and to thereby brake the rotor. The centrifugal weights then simultaneously act as centrifugal brake.

The following description of preferred embodiments serves in conjunction with the appended drawings to explain the invention in greater detail. In the drawings.

Figure 1:
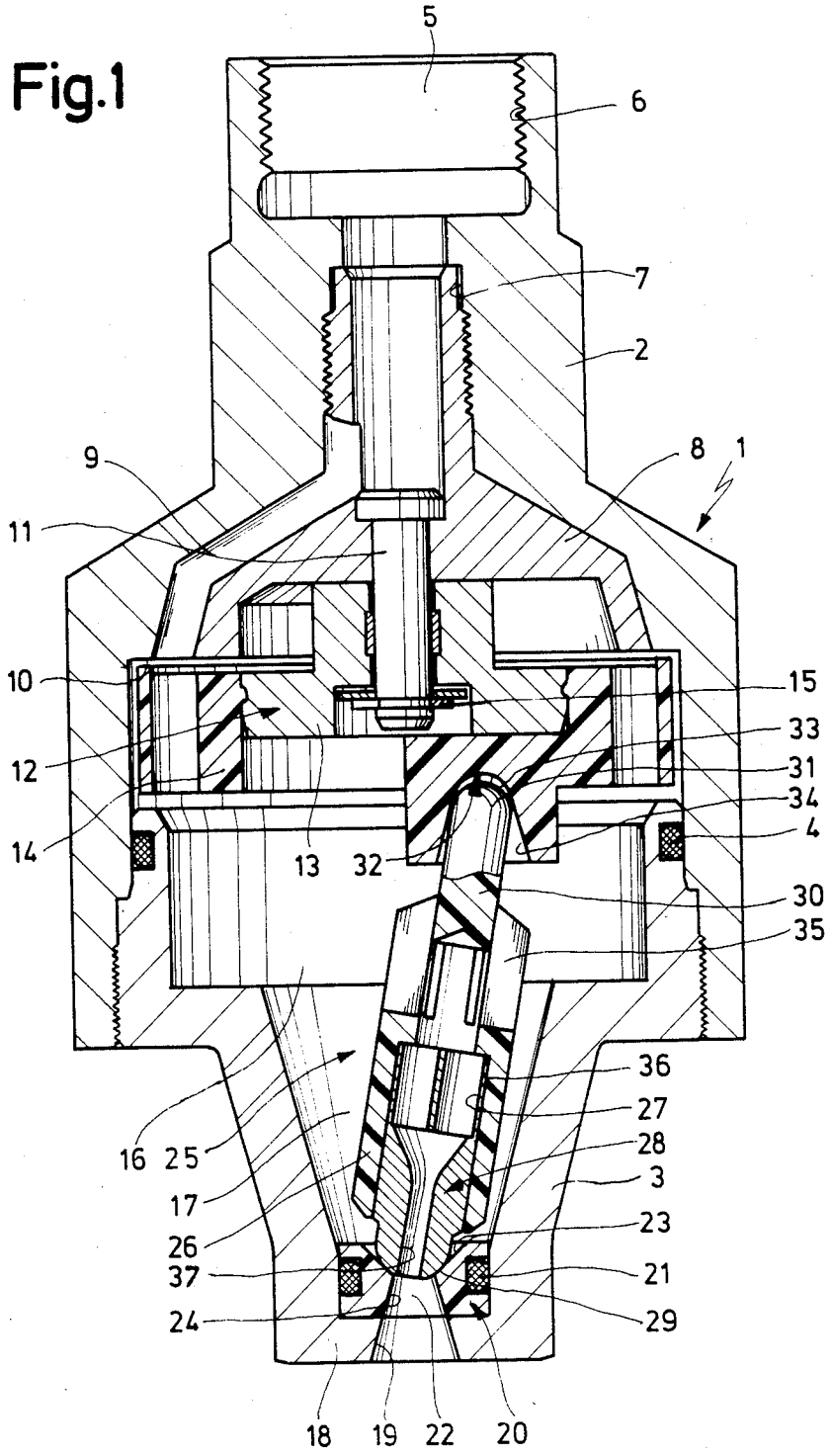
FIG. 1 is a sectional view of a first preferred embodiment of a rotor nozzle with a driver which is not adjustable.

The rotor nozzle illustrated in FIG. 1 comprises a housing 1 consisting of an expanding inflow component 2 and an outflow component 3 which is screwed into the inflow component. Outflow component 3 and inflow component 2 are sealed off from each other by an annular seal 4.

Inflow component 2 comprises a central inflow orifice 5 with an internal thread 6 for connection to a spraying tube, known per se, of a high-pressure cleaning device. The spraying tube is not depicted in the drawings.

Screwed into a central bore 7, from the expanding side of inflow component 2, is a baffle 8 comprising flow passages 9 for a cleaning liquid introduced into the housing through inflow orifice 5. The flow passages 9 terminate in a bottom 10 of inflow component 2 formed by inflow component 2 and baffle 8 which is screwed into inflow component 2.

A central journal 11 is held in baffle 8 and protrudes out of baffle 8 into the open interior of inflow component 2. Mounted for rotation on this journal 11 is a rotor 12 comprising an inner bearing block 13 acting as flywheel and a turbine body 14 held in annular configuration on the bearing block. The turbine body consists in a manner known per se of single blades arranged in the exit region of flow passages 9 such that rotor 12 is made to rotate about journal 11 by the liquid emerging from flow passages 9. Rotor 12 is axially secured on journal 11 by a retaining ring 15.

The bearing block 13 may, for example, consist of bearing bronze, while the turbine body 14 usually consists of plastic, for example, polyoxymethylene.

The liquid emerging from the turbine body 14 is collected in a receptacle 16 formed by outflow component 3 and disposed in opposite relation to baffle 8. Receptacle 16 opens into a conically tapering, central extension 17 which is closed off by a closure wall 18. A central, conically expanding exit orifice 19 is arranged in closure wall 18.

An annular cup-like member 20 made of plastic, for example, polyester abuts closure wall 18. It is sealed off from the inside wall of outflow component 3 by an annular seal 21 and contains a central aperture 22 which at the downstream end first exhibits a bearing region 23 of conically tapering configuration and then an adjoining exit zone 24 of conically expanding configuration. Exit zone 24 is so designed that the likewise conically expanding exit orifice 9 in the closure wall 18 always adjoins the exit zone 24.

An elongate member 25 is disposed in the conically tapering extension 17 of outflow component 3 and in receptacle 16. It consists of an essentially cylindrical plastic section 26 with a central blind bore 27 of stepwise tapering configuration which is open in the direction of exit orifice 19. A nozzle assembly 28 made of metal, for example, steel is inserted into blind bore 27 and protrudes with a ball-shaped end 29 from the plastic section 26. The ball-shaped end 29 plunges into the bearing region 23 of the cup-like member 20 and supports the elongate member 25 in the cup-like member 20.

At the other end, the plastic section 26 terminates in a peg-shaped elongation 30 which is likewise of spherical configuration at its free end 31. This spherical end 31 dips into a cup-shaped recess 32 which is integrally formed on turbine body 14 and acts as driver. In cross section, the cup-shaped recess 32 has a spherical bottom 33 adjoined by a side wall 34 which extends outwardly in conical configuration. The bottom is spaced radially from the axis of rotation of rotor 12 defined by journal 11. Hence the longitudinal axis of the elongate member 25 includes an acute angle with the axis of rotation of the rotor formed by journal 11.

The plastic section 26 comprises lateral inlet openings 35 for the cleaning liquid which travels from receptacle 16 through these into blind bore 27. The nozzle assembly 28 is open at the end inserted into the plastic section 26 and is designed as a diode 36. Downstream from diode 36 is an adjoining central nozzle opening 37 which first tapers and then exhibits a continuous cross-section. The nozzle opening opens into the exit zone 24 of cup-like member 20. After entering the blind bore 27, the cleaning liquid passes through nozzle assembly 28 as a sharply defined jet through exit orifice 19 into the ambient. The direction of the exiting jet coincides with the longitudinal direction of the elongate member 25, i.e., it is inclined in relation to the axis of rotation of rotor 12. The inclination is determined by the radial spacing of the cup-shaped recess 32 from the axis of rotation. During operation of the above-described rotor nozzle, the cleaning liquid is introduced through inflow orifice 5 and flows through flow passages 9 through the turbine body 14 which is thereby made to rotate. From the receptacle adjoining the turbine body 14, the cleaning liquid passes through the elongate member 25 and the nozzle assembly 28 in the form of a sharply defined jet into the ambient. Due to rotation of the rotor, the cup-shaped recess 32 acting as driver also revolves on a circular path about the axis of rotation of the rotor. Hence the elongate member 25 is driven along a conical surface, the apex of which is located at the center point of the ball-shaped end 29 of the nozzle assembly 28. The exiting jet of cleaning liquid, therefore, also moves on the outwardly opening lateral area of a cone.

It is imperative that the ball-shaped end 29 of the nozzle assembly 28 be forcefully pressed against the bearing region 23 of the cup-like member 20 by the liquid in order to achieve good sealing in this region. Since the elongate member 25 can rotate freely about its longitudinal axis both in relation to the cup-like member 20 and in relation to the cup-like recess 32, rotation of the elongate member about its own longitudinal axis at a speed substantially lower than the speed of the rotor occurs during operation. More specifically, the elongate member 25 essentially executes a wobble motion in the cup-like member 20 without powerfully rotating about its own longitudinal axis. This reduces the strain on the bearing formed by the cup-like member 20 and the ball-shaped end 29 of the nozzle assembly 28 during operation.

Figure 2:
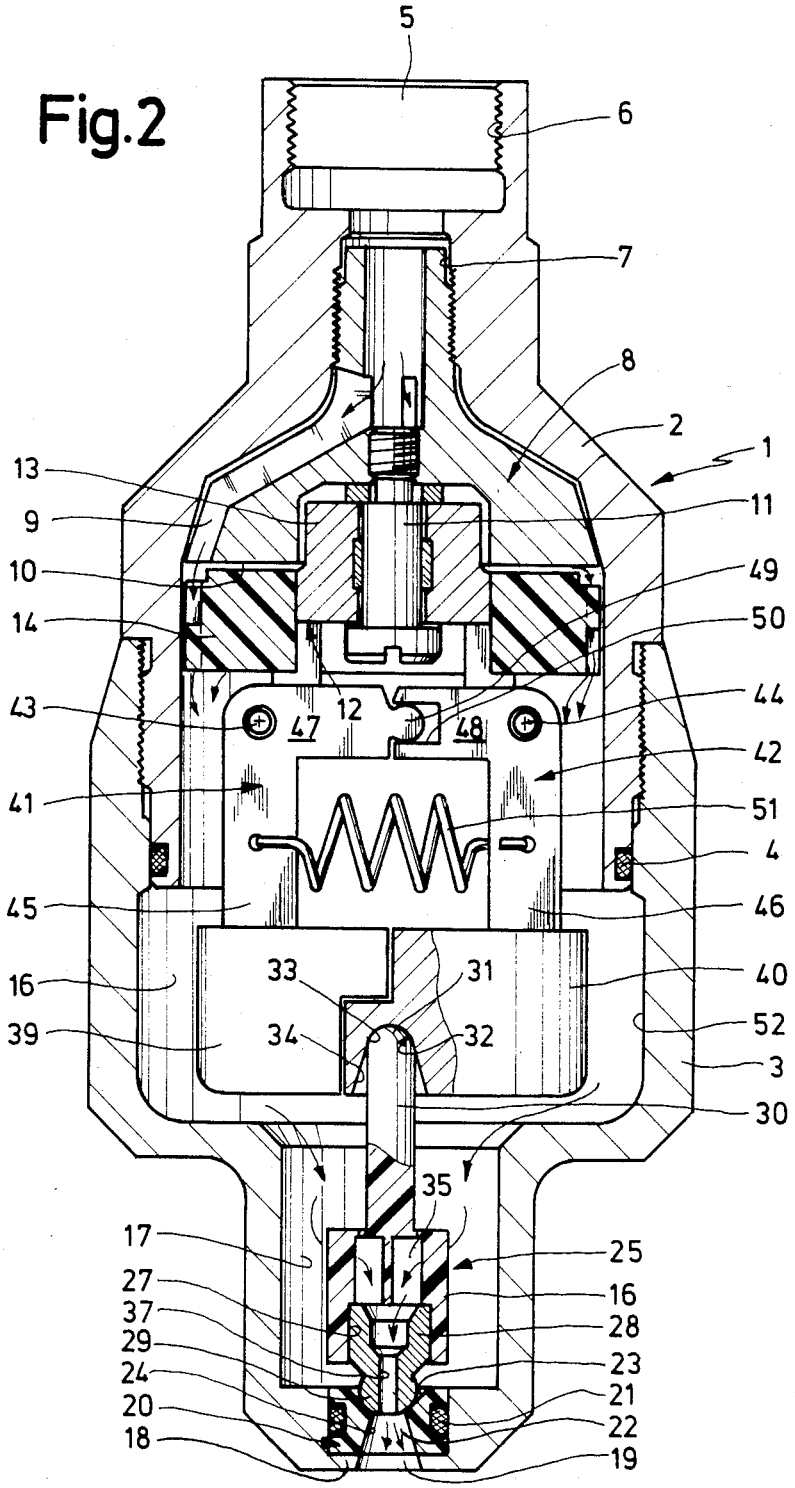
FIG. 2 is a view similar to FIG. 1 of a modified embodiment of a rotor nozzle with a driver which is adjustable in dependence upon rotational speed, at low rotational speeds.
Figure 3:
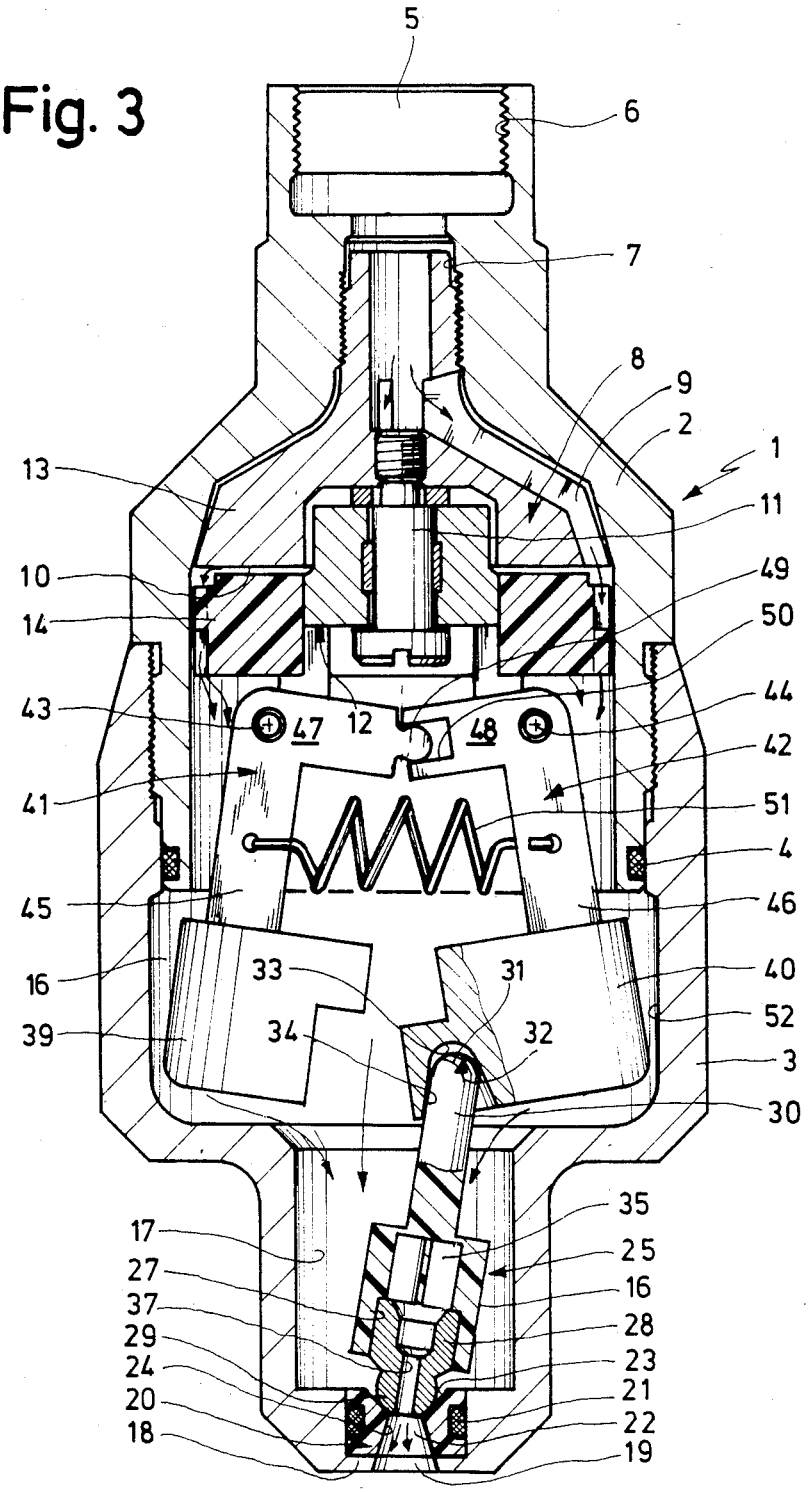
FIG. 3 is a view similar to FIG. 2 at high rotational speeds.

In the embodiment illustrated in FIGS. 2 and 3 which is of substantially similar design, like parts are designated by like reference numerals.

Insignificant differences are apparent from the outside: Outflow component 3 is screwed onto the outside of inflow component 2 and extension 17 is not of conical but of cylindrical configuration. Also, in the embodiment of FIGS. 2 and 3, the journal 11 is of the screw-in type, which eliminates retaining ring 15. However, all of these differences are trivial and such a design is also feasible in the FIG. 1 embodiment.

In contrast to the embodiment of FIG. 1, however, the cup-like recess 32 serving as driver for the elongate member 25 is neither integrally nor rigidly joined to the turbine body 14.

In the embodiment of FIGS. 2 and 3, two centrifugal weights 39 and 40 are mounted on rotor 12 by means of L-shaped arms 41 and 42 about bearing shafts 43 and 44 extending transversely to and at a distance from the axis of rotation of the rotor 12. The arms 41 and 42 each carry one of the centrifugal weights 39 and 40 on the vertical arm portions 45 and 46, respectively, which extend substantially parallel to the axis of rotation of the rotor. The horizontal arm portions 47 and 48 extending substantially perpendicularly to the axis of rotation of the rotor 12 are pivotably and displaceably coupled by a spherical end 49 of horizontal arm portion 47 engaging a rectangular recess 50 on the other horizontal arm portion 48. Arranged between vertical arm portions 45 and 46 is an extension spring 51 which swivels the two centrifugal weights 39 and 40 into their position near the axis of rotation (FIG. 2). The two centrifugal weights 39 and 40 are then disposed in opposite paired relation to each other symmetrically with the axis of rotation of the rotor.

Located in one (40) of the two centrifugal weights is the cup-shaped recess 32 into which the spherical end 31 of the elongate member 25 dips, as in the FIG. 1 embodiment. The centrifugal weights 39 and 40 are arranged in receptacle 16 and are so designed that when swivelled outwardly, they finally abut the inside wall 52 of the outflow component 3.

In operation, before the supply of liquid is switched on, the two centrifugal weights 39 and 40 are arranged in a position near the axis of rotation, into which they are brought by the extension spring 51. In this position, the cup-like recess 32 acting as driver is essentially located on the axis of rotation of the rotor. Hence the longitudinal axis of the elongate member 25 coincides with the axis of rotation of the rotor (FIG. 2). When a small amount of liquid is supplied no change occurs. In this operating position, the jet of liquid coincides with the axis of rotation of the rotor.

When the speed of the rotor increases as a result of an increase in the supply of liquid, the centrifugal weights 39 and 40 swivel outwardly against the force of the extension spring 51 (FIG. 3) and the cup-like recess 32 acting as driver is thereby moved further away from the axis of rotation of the rotor. This results in inclination of the elongate member 25 in relation to the axis of rotation of the rotor. Hence a jet of liquid which is inclined in relation to the axis of rotation of the rotor and extends around the lateral area of a cone, as described above, is now emitted. The apex angle of the lateral area of the cone depends on the speed of the rotor. At low speed, the apex angle is small. The apex angle increases as the speed increases. At maximum speed, the two centrifugal weights 39 and 40 abut the inside wall 52 and brake the rotor. Thus, the centrifugal weights simultaneously act as centrifugal brake.

Imbalances of the rotor are eliminated by paired arrangement of the centrifugal weights 39 and 40.

The dependence of the apex angle of the cone swept by the jet of cleaning liquid on the speed can be set by selection of the spring constant of the extension spring 51.

While adjustment of the spacing of the cup-like recess 32 from the axis of rotation of the rotor is speed-dependent in the embodiment of FIGS. 2 and 3, it is also possible for the cup-like recess 32 to be radially displaceably mounted on rotor 12, for example, by means of a screwthread drive or the like. The spacing of the cup-like recess 32 from the axis of rotation could then be adjusted to enable operation with a different apex angle of the jet of cleaning liquid, for example, for different purposes, but which remains fixed after adjustment.

What is claimed is:

1. Rotor nozzle for a high-pressure cleaning device comprising:

a housing, a rotor mounted for rotation in said housing, said rotor being made to rotate by the cleaning liquid, a driver connected to said rotor and spaced radially from the axis of rotation of said rotor, a nozzle arranged downstream from said rotor, the exit axis of said nozzle forming an acute angle with the axis of rotation of said rotor, a cup-like member open at its center and held on said housing an elongate member that mounts said nozzle to form a nozzle assembly that is supported at one ball-shaped end in said cup-like member said driver engaging the other end of said nozzle assembly in a matter that enables free rotation of said nozzle assembly about the longitudinal axis of said elongate member relative to said rotor and said rotor connected to said driver rotating said nozzle assembly about the fixed axis of said rotor such that the exiting jet of cleaning fluid moves around the lateral area of a cone.

2. Rotor nozzle as defined in claim 1, characterized in that:

said driver (32) is in the form of a cup-shaped recess into which the other end (31) of said elongate member (25) dips.

3. Rotor nozzle as defined in claim 2, characterized in that:

the other end (31) is of spherical configuration.

4. Rotor nozzle as defined in claim 1, characterized in that:

said elongate member (25) comprises a substantially cylindrical plastic section (26) into which a nozzle assembly made of metal is inserted.

5. Rotor nozzle as defined in claim 4, characterized in that:

said nozzle assembly (28) forms the ball-shaped end (29) resting against said cup-like member (20), and in that:

said cup-like member (20) consists of plastic.

6. Rotor nozzle as defined in claim 1, characterized in that:

said elongate member (25) comprises lateral inlet openings (35) for the cleaning liquid.

7. Rotor nozzle as defined in claim 1, characterized in that:

the radial spacing of said driver (32) from the axis of rotation of said rotor (12) is adjustable.

8. Rotor nozzle as defined in claim 7, characterized in that:

said driver (32) is pretensioned by spring means (51) towards the the axis of rotation of said rotor (12) and can be moved further away from the axis of rotation of said rotor (12) by the action of the centrifugal force when said rotor (12) rotates, against the action of said spring means (51).

9. Rotor nozzle as defined in claim 8, characterized in that:

a plurality of centrifugal weights are movably arranged on said rotor and are urged into a position near the axis of rotation by said spring means, and in that:

one of said plurality of centrifugal weights carries the driver.

10. Rotor nozzle as defined in claim 9, characterized in that:

said plurality of centrifugal weights is two which are disposed in opposite relation to each other symmetrically with respect to the axis of rotation are movably arranged on said rotor.

11. Rotor nozzle as defined in claim 9, characterized in that:

at maximum speed of said rotor (12), said centrifugal weights (39,40) abut the inside wall (52) of said housing (1) and thereby brake said rotor (12).

* * * * *